US006655094B2

(12) United States Patent
Morphet

(10) Patent No.: US 6,655,094 B2
(45) Date of Patent: Dec. 2, 2003

(54) FLASHING SYSTEM

(75) Inventor: Michael Morphet, Halton (GB)

(73) Assignee: Ultraframe (UK) Limited, Clitheroe (GB)

( * ) Notice: Subject to any disclaimer, the term of this patent is extended or adjusted under 35 U.S.C. 154(b) by 0 days.

(21) Appl. No.: 10/093,807

(22) Filed: Mar. 8, 2002

(65) Prior Publication Data

US 2002/0124480 A1 Sep. 12, 2002

(30) Foreign Application Priority Data

Mar. 9, 2001 (GB) ..... 0105889

(51) Int. Cl.[7] ..... E04D 3/38
(52) U.S. Cl. ..... 52/58; 52/474
(58) Field of Search ..... 52/58–62, 474

(56) References Cited

U.S. PATENT DOCUMENTS 2,271,710 A * 2/1942 Orth ..... 52/61
2,664,177 A * 12/1953 Hammitt et al. ..... 52/92.2
2,676,553 A * 4/1954 Orth ..... 52/60
5,123,208 A 6/1992 Kirby et al.
5,953,869 A * 9/1999 Balfour et al. ..... 52/200

FOREIGN PATENT DOCUMENTS

GB 1073439 A 6/1967
GB 2210648 A 6/1989
GB 2289704 A 11/1995

* cited by examiner

*Primary Examiner*—Ramon O. Ramirez
(74) *Attorney, Agent, or Firm*—Wood, Phillips, Katz, Clark & Mortimer

(57) ABSTRACT

A flashing comprises a preformed plastics element having a body (1) with an inner face (13) and an outer face (11), the body having an upper edge (3), a lower edge (5), a first end (7) and a second end (9), and a continuous lip (15) formed along the upper edge, which lip is directed away from the outer face of the body.

21 Claims, 6 Drawing Sheets

Figures 1, 2, 3:
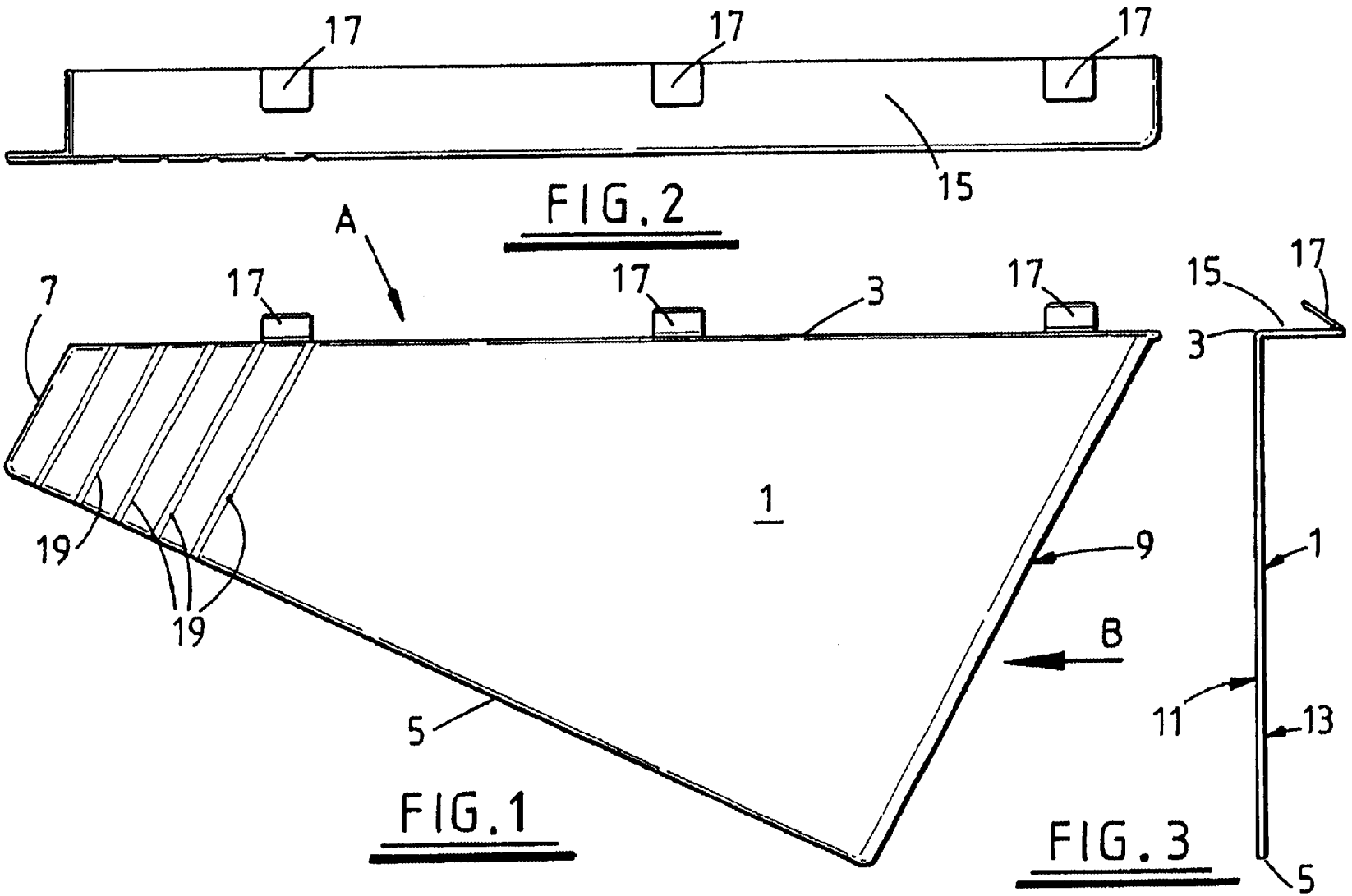

17
15
3
1
13
5
11

17
17
17
15

9
B
3
1
17
17
A
17
5

19
19
7

FLASHING SYSTEM

The present invention relates to a flashing system for a conservatory but without limitation to such an application.

Flashings are used when a roof of one building abuts against an adjacent wall to inhibit water ingress at the junction of the two. The roof in question will usually have a pitch but may be flat, and the adjacent wall may comprise courses of masonry, or a wall, which is not obviously coursed—such as a rendered wall or a wall clad with boards or shingles.

Traditionally, where a pitched roof abuts a wall of coursed brickwork, a lead flashing is provided. For the case of a conservatory roof, the position of the end glazing bar is determined and the mortar chased out from between courses of brickwork above the line of the glazing bar. A soaker is first formed to provide an upstand. The soaker has its lower edge formed with a channel to be received in a recess of the glazing bar. Then discrete pieces of lead are cut and formed into the required shape and then placed in position in overlapping relation with each other and with the soaker starting at the lower extremity of the roof. Each piece has a lip formed along its upper edge to be received in the chased groove of the brickwork. The need to form numerous pieces of lead in this manner to suit each application to accommodate pitch variations and different course depths is particularly time consuming.

The present invention aims to provide a solution, which avoids this problem.

Accordingly, a first aspect of the present invention provides a flashing comprising a preformed plastics element having a body with an inner face and an outer face., the body having an upper edge, a lower edge, a first or upper end and a second or lower end, and a continuous lip is formed along the upper edge, which lip is directed away from the outer face of the body.

More particularly, the lip is provided with wedging means. The wedging means may comprise a plurality of discrete spaced elements such as tabs. More preferably the tabs are deformable and preferably depend from an edge of the lip remote from the body. More preferably still, the tabs are directed towards the body to provide an edge abutment. The tabs are preferably formed on an upper side of said lip. The tabs and/or the lip may have a surface finish to provide a key for mortar or sealant.

The upper and lower ends can be substantially parallel, although that is not necessary. In one embodiment the upper and lower edges are substantially parallel and set at right angles to the upper and lower ends. In another embodiment the upper and lower edges converge in a direction from the lower end.

In use a plurality of the flashings are used in end overlapping relation, i.e. with a lower end overlying and overlapping with an upper end of an adjacent flashing. Preferably sealing means is provided to seal the overlapping ends. In one embodiment the inner face is provided with a resilient sealing element disposed adjacent its lower end. The sealing element may take the form of a resilient foam strip. Preferably the upper end of the flashing is provided with one or a plurality of spaced grooves on its outer face adjacent the upper end.

In said one embodiment, one end (the lower end) is provided with a recess for receiving the other end of an adjacent flashing. The lower end is joggled to overlap the outer surface of the other end of an adjacent flashing in use.

Another aspect of the invention provides a flashing system utilizing a plurality of the aforedescribed flashings in conjunction with an elongate extruded soaker channel, the soaker channel having a drainage groove and an upstanding wall which is overlaid by the lower edge of the flashings.

In use the aforesaid soaker channel cooperates with a glazing bar. More particularly, the glazing bar has a recess to receive the drainage channel. More particularly still, the glazing bar is provided with a capping which is cooperable with the glazing bar and which covers the soaker channel. More particularly, the capping has an upstanding lip that abuts the outer face of the flashings in use. The flashing system further preferably comprises a saddle flashing that is formed from plastics with a lip to an upper edge thereof and a reception location to receive a ridge beam. More particularly, the saddle flashing is formed of two parts with the aforedescribed recess formed in a first part as a projection from a planar flange, and the lip formed on a second planar part that overlies the aforesaid flange part in use. The saddle recess is vertically adjustable with respect to the saddle flashing. The invention also extends to a soaker channel extrusion as described herein and a saddle flashing as described herein.

Figure 4:
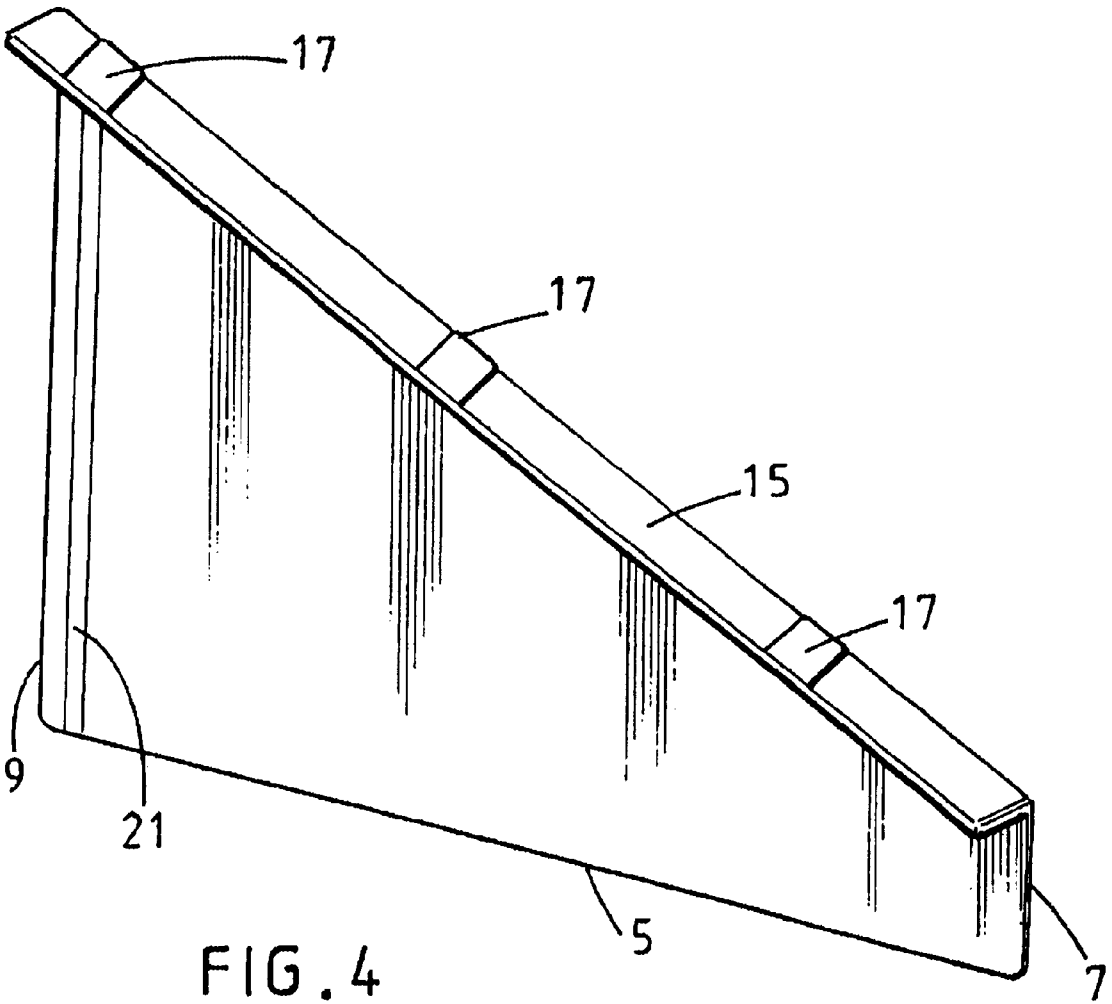
Figure 5:
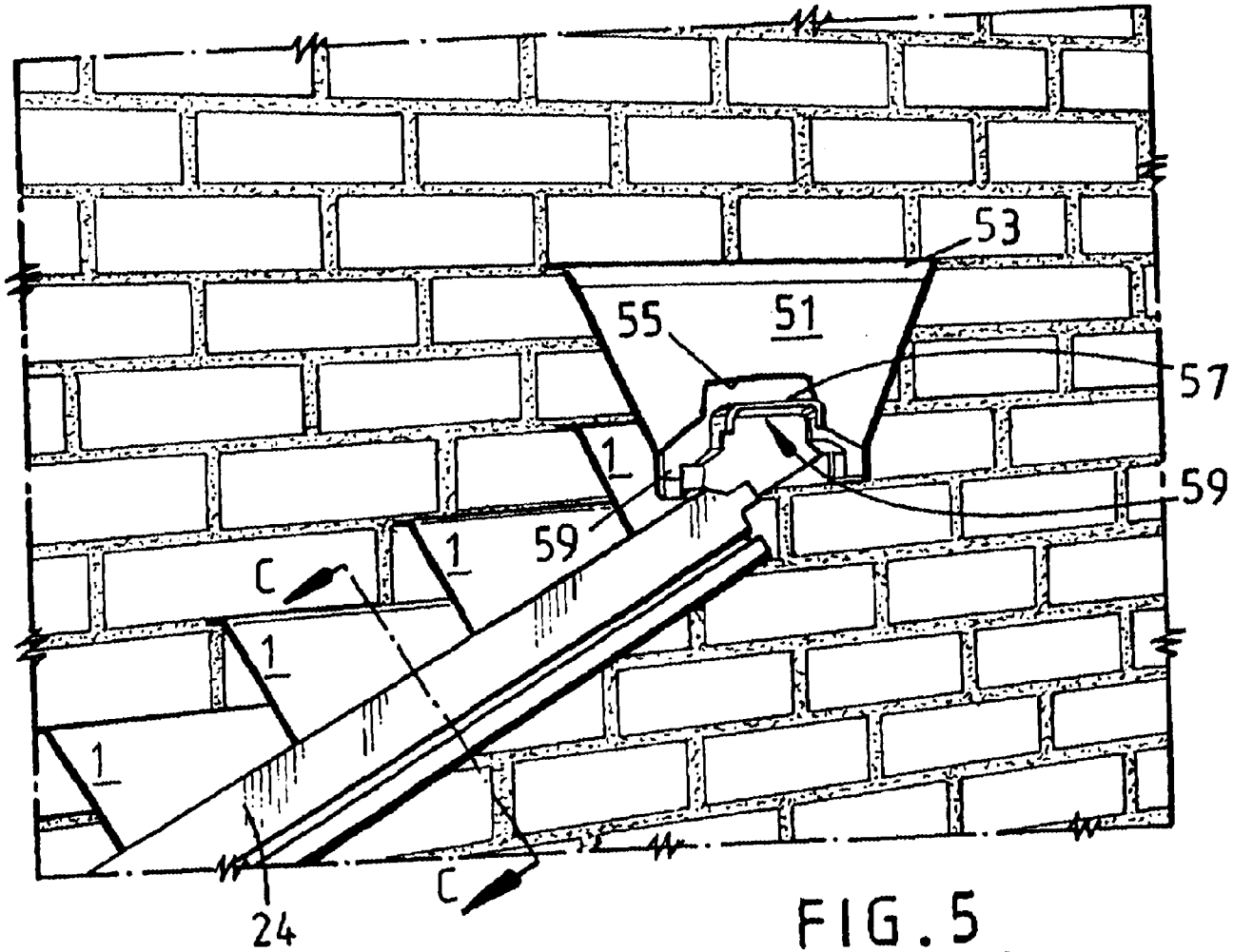
Figure 6:
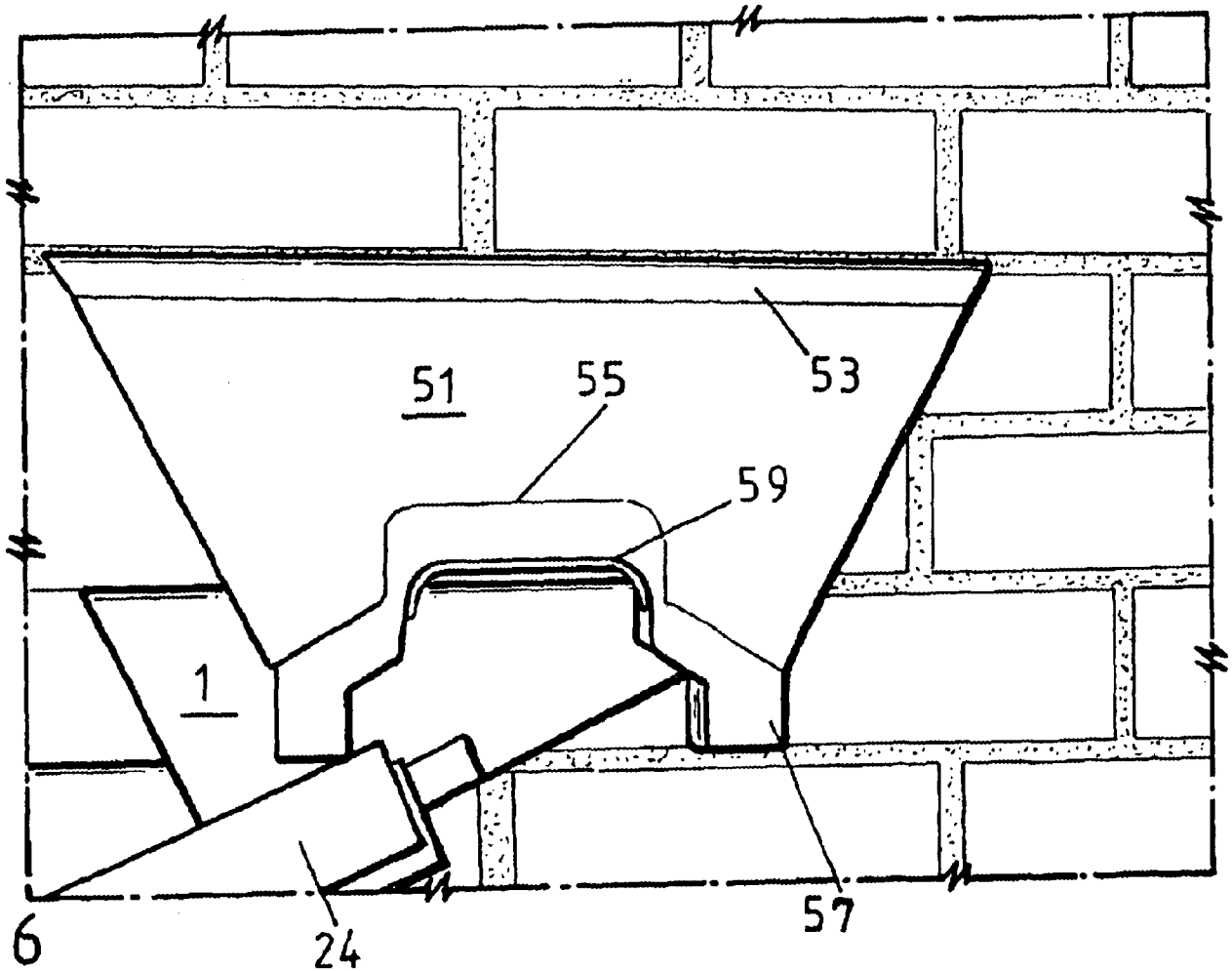

The present invention will now be described further, by way of example only, with reference to the accompanying drawings, in which:

FIG. 1 is a front view of a first embodiment of flashing element according to one aspect of the invention, FIG. 2 is a plan view of the flashing of FIG. 1, looking in the direction of arrow A, FIG. 3 is an end view of the flashing of FIG. 1 looking in the direction of arrow B, FIG. 4, is a perspective view of the rear of the flashing of FIG. 1, FIG. 5 is a perspective view of a flashing system for a conservatory roof utilizing the flashing element of FIG. 1, FIG. 6 is a perspective view of the saddle shown in FIG. 5, to a larger scale.

Figure 7:
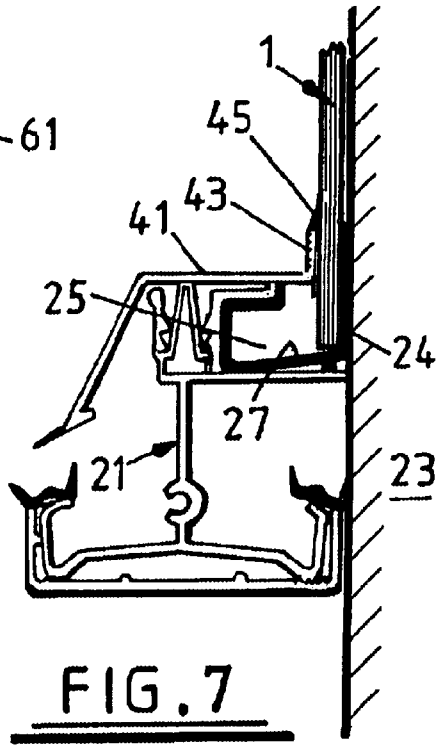
Figure 7A:
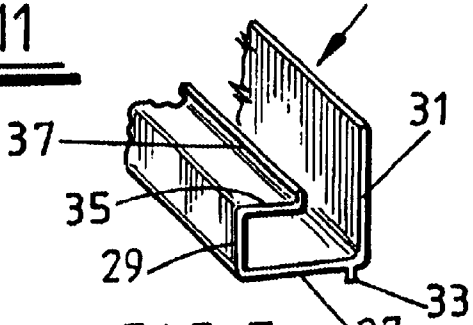
Figure 11:
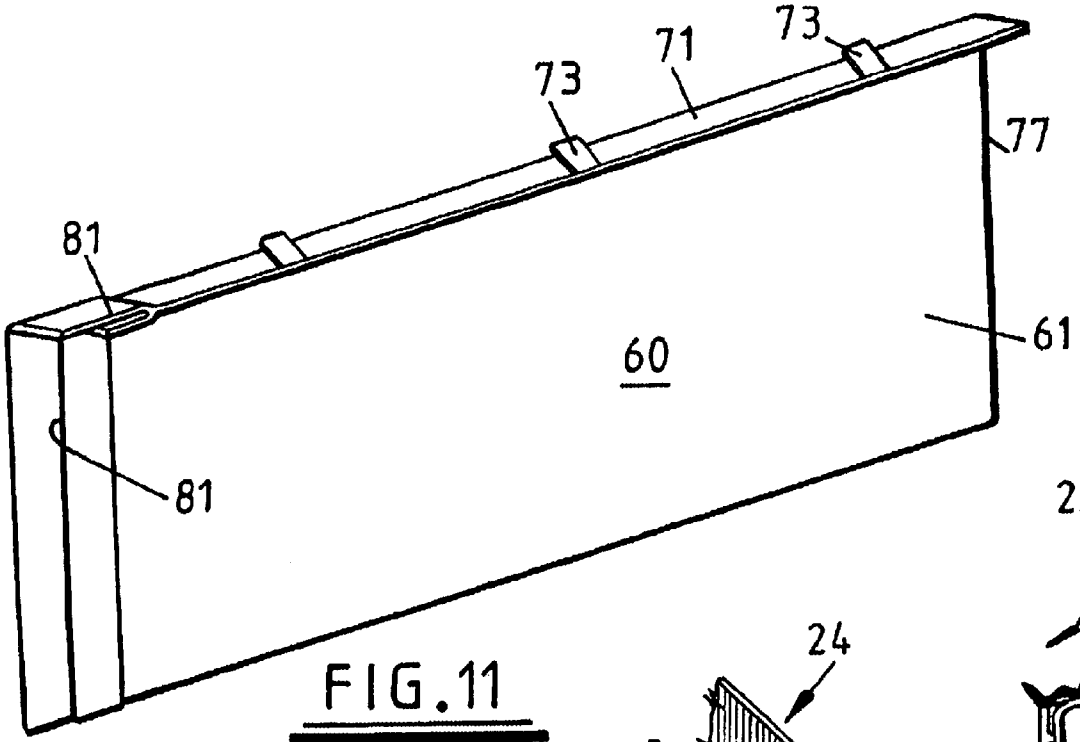
Figures 8, 9, 10:
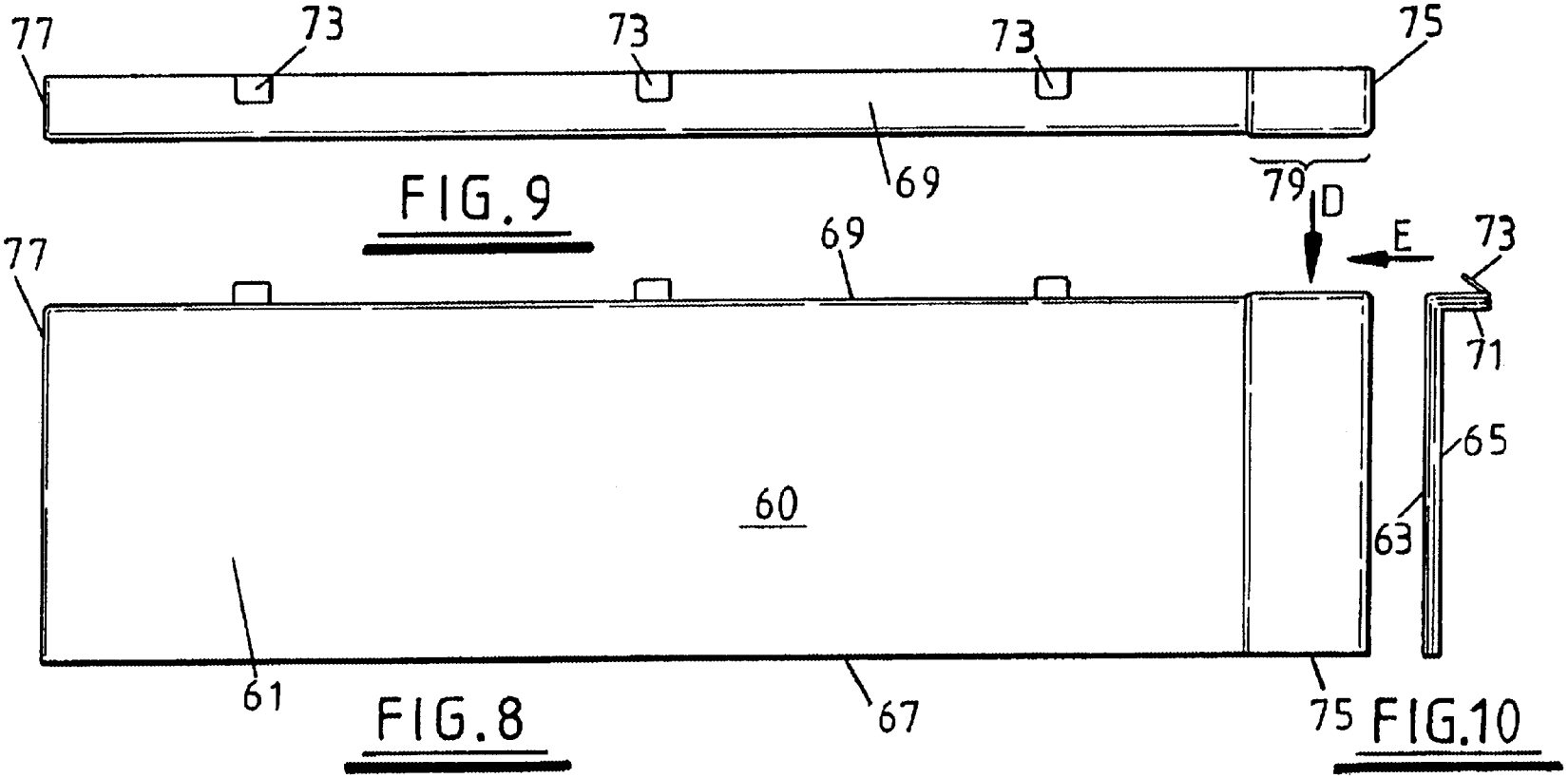

FIG. 7 is a schematic section taken on c—c of FIG. 5,

FIG. 7*a* illustrates a perspective view of one end of a soaker channel shown in FIG. 7, FIG. 8 is a front view of an alternative embodiment of flashing according to the invention, FIG. 9 is a plan view of FIG. 8 looking in the direction of arrow D, FIG. 10 is an end view of FIG. 8 looking in the direction of arrow E, and FIG. 11 is a perspective view of the flashing of FIG. 10 looking from the rear, one end and above.

The various aspects of the present invention are described in relation to the application to conservatories, but it will be appreciated that they are applicable to other applications.

Referring firstly to FIGS. 1 to 4, a first embodiment of flashing is illustrated. It comprises a body molded from plastics material. The body has an upper edge 3, a lower edge 5, and opposite ends 7, 9. The opposite ends are conveniently referred to as inner 7 and outer 9 ends in this embodiment. The opposite ends are substantially parallel in the illustrated embodiment. The lower edges converge toward the upper edge as viewed in the direction of the upper end. In the context of the application, inner refers to that end that is nearest to the ridge or apex of the roof to which the flashing is being applied. The body 1 has an outer face 11 and a rear face 13. The body 1 is generally planar. The upper edge of the body is provided with a continuous lip 15 that is turned away from the outer face 11. It is preferred if this lip is disposed at substantially 90° to the planar of the body 1. It could have a slightly greater included angle—but would not usually have an included angle of less than 90°. This ensures that any water on the lip is shed towards the body. The lip is provided with a plurality of tabs 17 disposed at spaced intervals along the length thereof. The tabs depend from the leading edge of the lip 15 in the illustrated embodiment and are angled back towards the outer face of the body. In use, the lips serve as wedging elements that are deformable to hold the flashing in place as described further hereinafter. Other configurations may be used which provide a similar wedging effect that resists pulling out of the flashing once installed.

The outer face of the flashing is provided with a plurality of spaced grooves 19 inset from the inner end of the flashing. These grooves serve in use, to capture water and prevent it reaching the inner end of the flashing. The rear face of the flashing is provided with a resilient sealing element 21 adjacent the outer edge. In use outer end of one flashing overlies the inner end of an adjacent flashing and the seal contacts the outer face of the overlapping flashing to inhibit the passage of water. The sealing element conveniently comprises a resilient compressible foam.

A plurality of the flashing elements illustrated in FIGS. 1 to 4 are utilized in combination to provide the likes of a conservatory roof with a flashing as shown and described in further detail with reference to FIGS. 5, 6 and 7. The flashings are made in left and right-handed versions to suit the opposite pitches of an apex roof. The flashing of FIGS. 1 to 4 is of right hand configuration. The left hand configuration is a mirror image. The flashings operate in conjunction with an extruded soaker channel 23 as shown in FIGS. 7 and 7*a*. An end wall glazing bar is shown at 21 in position up to an end wall 23. It has a limb 25, which provides a recess for the soaker channel 23. The soaker channel comprises a lower wall 27 and two upstanding walls 29, 31. The lower wall 27 slopes as seen in cross-section (FIG. 7) so that water is displaced to the lower side adjacent limb 29. This enhances drainage. The rib 33 ensures that the base 27 remains inclined when installed. The upstanding limb 31 is longer than limb 29 which has a returned limb 35 to partially close off the top of the soaker channel. The end of the limb 35 has an upstanding lip 37.

In use the limb 31 lies immediately adjacent the surface of wall 23. The flashings are positioned outwardly thereof. Having chased out the required amount of mortar, the flashings can be quickly pushed in place starting at the lowermost position and proceeding upwardly toward the apex. The lip 15 of each flashing is received in a recess in the wall 23, whilst the lower edge lies in the soaker channel 23, and as will be apparent from FIG. 5, the inner end of one flashing is overlaid by the outer end of the next adjacent flashing. The next overlapping flashing is positioned so that the grooves 19 are covered. The seal 21 contacts the underlying flashing and the wall.

It will be seen from FIG. 7 that the glazing bar is provided with a capping 41 that engages with the glazing bar 21 in a push fit manner and has a raised lip 43 with integrally molded flexible sealing edge 45 that abuts the flashings to minimize water ingress into the soaker channel.

At the apex a special saddle flashing is provided as illustrated in FIGS. 5 and 6. It comprises a first part, which has a substantially planar body 51 whose upper edge 53 is provided with a lip to be received in the chased out brickwork. The lower edge 55 is cut away to receive a saddle element 57 that is vertically slidable with respect to the first part. The saddle element includes a recess 59 that is shaped to receive the ridge beam of the conservatory roof (not illustrated). In the illustrated embodiment the recess is generally unshaped. The saddle element overlies the flashings 1 and the body 51 overlies a planar flange 57 of the saddle. The arrangement allows the ridge to be sealed without having to make a purpose designed lead saddle flashing.

Reference is now made to FIGS. 8 to 11, which illustrates an alternative embodiment of flashing that can be used in place of the flashing of FIGS. 1 to 4. This alternative can be used where the wall against which the roof is received does not have discrete courses of masonry, but instead comprises say a rendered wall, where it is possible to form a single groove in the wall that is disposed substantially parallel to the glazing bar and runs from top to bottom. In fact such an arrangement can be used for a coursed wall structure, but is less traditional.

The flashing comprises a plurality of identical elements 60 that are molded from plastics and are configured to be interconnectable end to end to build up a flashing of the desired length. Each flashing has a planar body 61 having an outer face 63 and an inner face 65, a lower edge 67 and an upper edge 69. The body is rectangular in this embodiment. The upper edge is provided with a continuous lip 21. The lip is provided with a plurality of special tabs 73. The construction of the lip and the tabs mirrors the embodiment of FIG. 1 and is not described in further detail. The flashing has a lower end 75 and an upper end 27. The lower end is swaged at 79 to fit over the upper end of the next adjacent flashing. Furthermore, the swaging provides a recess 81 into which the other end of a mating flashing is received in order to provide a means of connecting the flashing in a sealing manner. A flexible sealing mastic may be applied in the recess 81 to assist sealing. This alternative embodiment of flashing is used in the same manner as that of FIG. 1 to form a flashing system for the glazing bar of the conservatory roof and hence its use is not described further. It will however, be appreciated that this flashing is also particularly suited to flat roof constructions.

Both flashing may be used in other roof applications as an alternative to lead or felt flashing systems.

The aforedescribed flashings and the saddle flashing components are made from any desired colour of plastics material, although it is envisaged that they may be made of pressed metal sheet. A grey colour may be utilized to simulate the appearance of a traditional lead flashing.

What is claimed is:

1. A flashing comprising a preformed plastics element having a body with an inner face and an outer face, the body having an upper edge, a lower edge, a first end and a second end, and a continuous lip formed along the upper edge, which lip is directed away from the outer face of the body, wherein the upper and lower edges converge in a direction from the second end.

2. A flashing comprising a preformed plastics element having a body with an inner face and an outer face, the body having an upper edge, a lower edge, a first end and a second end, and a continuous lip formed along the upper edge, which lip is directed away from the outer face of the body, wherein the inner face is provided with a resilient sealing element disposed adjacent its second end for sealing with an overlapping flashing.

3. A flashing as claimed in claim 2, wherein the sealing element is a resilient foam strip.

4. A flashing comprising a preformed plastics element having a body with an inner face and an outer face, the body having an upper edge, a lower edge, a first end and a second end, and a continuous lip formed along the upper edge, which lip is directed away from the outer face of the body, wherein the first end is provided with at least one groove on its outer face adjacent the first end.

5. A flashing comprising a preformed plastics element having a body with an inner face and an outer face, the body having an upper edge, a lower edge, a first end and a second end, and a continuous lip formed along the upper edge, which lip is directed away from the outer face of the body, wherein the second end has a recess for receiving the other end of an adjacent flashing.

6. A flashing as claimed in claim 5, wherein the lower end is joggled to overlap the outer surface of the other end of an adjacent flashing in use.

7. A flashing as claimed in any one of claims 1 through 6, wherein the lip is provided with wedging means.

8. A flashing as claimed in claim 7, wherein the wedging means comprises a plurality of discrete spaced elements.

9. A flashing as claimed in claim 8, wherein the discrete spaced elements are tabs.

10. A flashing as claimed in claim 9 wherein the tabs are deformable.

11. A flashing as claimed in claim 10, wherein the tabs depend from an edge of the lip remote from the body.

12. A flashing as claimed in claim 9, wherein the tabs are directed towards the body to provide an edge abutment.

13. A flashing as claimed in claim 12, wherein the lip has an upper side and the tabs are formed on the upper side of said lip.

14. A flashing as claimed in claim 9, wherein at least one of the tabs and the lip have a surface finish to provide a key for mortar or sealant.

15. A flashing as claimed in any one of claims 1 through 6, wherein the first and second ends are substantially parallel.

16. A flashing as claimed in claim 15, wherein the upper and lower edges are substantially parallel and set at right angles to the upper and lower ends.

17. A flashing system comprising a plurality of flashings, each as claimed in any one of claims 1, 2, 4 and 5, in conjunction with an elongate, extruded soaker channel, the soaker channel having a drainage groove and an upstanding wall, which is overlaid by the lower edge of the flashing.

18. A flashing system comprising a plurality of flashings, each in the form of a preformed plastics elements having a body with an inner face and an outer face, the body having an upper edge, a lower edge, a first end and a second end, and a continuous lip formed along the upper edge, which lip is directed away from the outer face of the body, in conjunction with an elongate, extruded soaker channel, the soaker channel having a drainage groove and an upstanding wall, which is overlaid by the lower edge of the flashing, the flashing system further comprising a saddle flashing that is formed from plastics with a lip to an upper edge thereof and a reception location to receive a ridge beam, wherein the saddle flashing is formed of two parts with the above-described recess formed in a first part as a projection from a planar flange, and wherein the lip is formed on a second planar part that overlies the aforesaid flange in use.

19. A flashing system comprising a plurality of flashings, each in the form of a preformed plastics elements having a body with an inner face and an outer face, the body having an upper edge, a lower edge, a first end and a second end, and a continuous lip formed along the upper edge, which lip is directed away from the outer face of the body, in conjunction with an elongate, extruded soaker channel, the soaker channel having a drainage groove and an upstanding wall, which is overlaid by the lower edge of the flashing, the flashing system further comprising a saddle flashing that is formed from plastics with a lip to an upper edge thereof and a reception location to receive a ridge beam, wherein the saddle recess is vertically adjustable with respect to the saddle flashing.

20. A saddle flashing for a flashing system, the saddle flashing being formed from plastics with a lip to an upper edge thereof and a reception location to receive a ridge beam wherein the saddle flashing is formed of two parts with a recess formed in a first part as a projection from a planar flange, and the lip formed on a second planar part that overlies the aforesaid flange part in use.

21. A saddle flashing as claimed in claim 20, wherein the saddle recess is vertically adjustable with respect to the saddle flashing.

* * * * *